United States Patent [19]

Lawrence et al.

[11] 4,416,382

[45] Nov. 22, 1983

[54] MERCURY CONTAINER

[75] Inventors: James B. Lawrence; Bruce J. Lawrence, both of Coopersburg, Pa.

[73] Assignee: Bethlehem Apparatus Company, Inc., Hellertown, Pa.

[21] Appl. No.: 360,378

[22] Filed: Mar. 22, 1982

[51] Int. Cl.[3] ..... B65D 55/00

[52] U.S. Cl. ..... 215/231

[58] Field of Search ..... 215/6, 231

[56] References Cited

U.S. PATENT DOCUMENTS

| | | | |
|---|---|---|---|
| 96,871 | 11/1869 | Blanchard | 215/6 |
| 422,934 | 3/1890 | Gunkle | 215/231 |
| 1,609,447 | 12/1926 | Ward | 215/6 |
| 1,657,168 | 1/1928 | Marrian | 215/6 |
| 2,086,073 | 7/1937 | Francescon | 215/6 X |
| 3,580,409 | 5/1971 | Soboleski | 215/231 |
| 3,998,349 | 12/1976 | Megowen | 215/231 |
| 4,065,018 | 12/1977 | Megowen et al. | 215/231 |

*Primary Examiner*—Donald F. Norton

*Attorney, Agent, or Firm*—John I. Iverson

[57] ABSTRACT

A container for the transport and storage of metallic mercury (Hg). A plastic thimble having a small opening in the upper side wall is disposed in the neck of the container to prevent oxidation of the mercury in the container and to retain mercury that would otherwise leak out due to expansion.

5 Claims, 3 Drawing Figures

MERCURY CONTAINER

BACKGROUND OF THE INVENTION

This invention relates to a container for the transport and storage of metallic mercury (Hg). It relates particularly to a container for the transport and storage of refined, high purity mercury and to prevent the contamination and leakage of the mercury.

Metallic mercury is used for many purposes such as lamps, electrical equipment, thermometers, barometers and many other industrial and consumer products. Many of these products require mercury of very high purity.

Previously, mercury was shipped from the producer or refiner to a user in a glass bottle or flask sealed with a screw cap or other stopper. These containers are not completely filled but are provided with a headspace sufficient to permit the expansion of the mercury due to a rise in temperature during its transport or storage. The air remaining in the headspace of the bottle or flask will, in time, react with the mercury and form mercuric oxide products so that high purity mercury is sometimes rendered unsuitable for uses that require mercury of very high purity. The contaminated mercury must then be further refined or filtered to remove the oxidation impurities. The mercuric oxides also form a permanent ring on the interior surface of the container that prevents the reuse or recycling of the container. The toxicity of the residual mercury in such containers requires special and expensive disposal of the used containers. Attempts to fill the headspace with a nonoxidizing atmosphere have not been successful since they require an airtight cap or stopper and the container once opened, loses the special atmosphere.

In addition, special care must be used in filling the bottles so that there remains sufficient headspace to permit considerable expansion of the mercury. If the headspace becomes completely filled with the expanded mercury, the mercury will leak out around the threads of the cap because of capillary attraction and rise. Since mercury is toxic, such leakage could present a serious health hazard.

SUMMARY OF THE INVENTION

It is therefore an object of this invention to provide a container for the transport and storage of metallic mercury which permits the mercury to expand if necessary without leakage during its transport and storage therein, and also protects the mercury from oxide contamination.

It is a further object of this invention to provide a container for the transport and storage of metallic mercury that is inexpensive, reusable, easily filled and emptied.

It is a still further object of this invention to provide a container for the transport and storage of metallic mercury that eliminates the need for further refining or filtering of the mercury to remove oxide impurities once it has arrived at its destination.

DESCRIPTION OF PREFERRED EMBODIMENT

Figure 1:
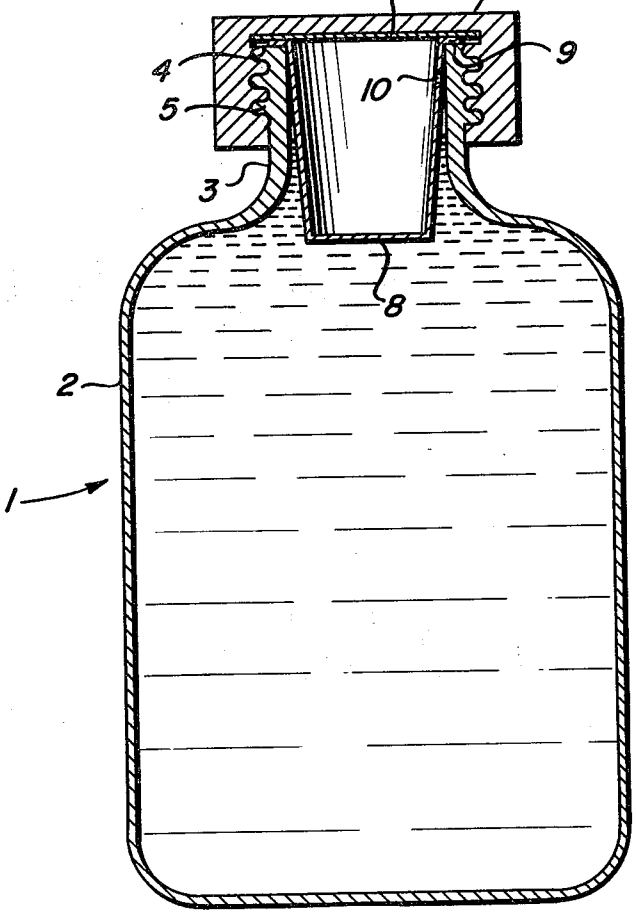

FIG. 1 illustrates the container 1 of this invention. Container 1 comprises a glass bottle 2 having a cylindrical neck 3 that terminates in a rim 4. The glass bottle 2 is preferably brown to prevent light from reacting with the mercury. Neck 3 is provided with threads 5 formed on the outer surface to accomodate a threaded phenolic closure member 6. The closure member 6 preferably has a polyethylene liner 7 on the inside surface. A plastic thimble 8 is disposed in the neck 3 of the glass bottle 2 as best illustrated in FIG. 1. Thimble 8 is preferably made of polyethylene. Thimble 8 has a truncated conical shape and is provided with a flange 9 adapted to rest on the rim 4 of bottle 2. The thimble 8 is best illustrated in FIG. 3.

Figure 3:
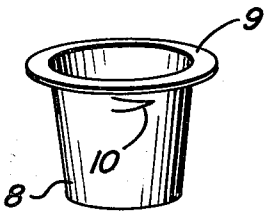
FIG. 3 is an elevational view in perspective of the thimble used in this invention.

Two small substantially horizontal intersecting slits are made in the upper side wall of the thimble 8 as shown in FIG. 3 to provide a small flap-like opening 10. The opening 10 is preferably made by a short narrow horizontal cut just below flange 9 and a short angled cut to form a triangular flap, the sides of which will press against each other, keeping the flap-like opening 10 normally closed. Other shapes of openings may also be used depending on the thickness and stiffness of the plastic thimble 8. In all cases, the opening 10 should be small and normally closed until pressed open by the expanding mercury.

In filling the container 1 of this invention, metallic mercury is added to the bottle 2 up to essentially the bottom of the neck 3. Thimble 8 is then inserted in the neck 3 displacing some of the mercury to fill the space as shown in FIG. 1 between the outer side wall of the thimble 8 and the inner wall surface of the neck 3 of bottle 2. Preferably the level of the mercury so displaced is just below opening 10 in the side wall of thimble 8. Closure member 6 is then screwed tightly on neck 3. Liner 7 in the closure member 6 and the flange 9 of the thimble 8 provide a tight gasket to prevent the entry of air into the bottle 2 or leakage of the mercury out around the threads of closure member 6. Since the opening 10 in the thimble 8 is normally closed, any air remaining in the thimble will not contact the mercury in bottle 2.

Figure 2:
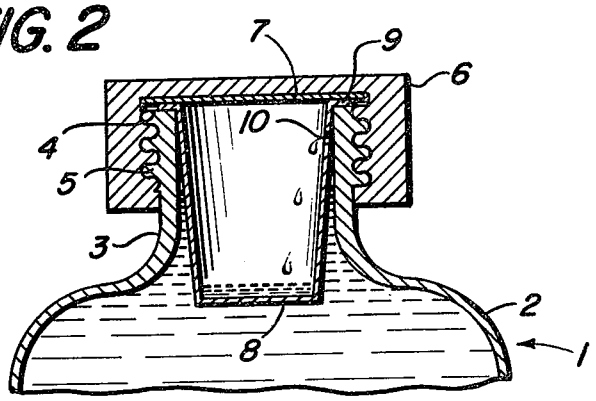
FIGS. 1 and 2 are vertical sectional views of the preferred embodiment of this invention.

Should the ambient temperature of the mercury in bottle 2 rise and cause the mercury to expand, the pressure of the dense mercury will cause the sides of the flip-like opening 10 to deform and open slightly to permit a small amount of the excess mercury to flow into the cup of thimble 8 as shown in FIG. 2. The sides of the flap-like opening 10 should be at least 10 mm. long but no greater than 20 mm. long to provide a proper opening and closing action in a 1 mm. thick polyethylene sidewall of thimble 8.

A specific example of this invention uses a 360 ml. amber colored glass bottle, Model No. 1509, sold by Brockway Glass Company, Brockway, Pa., with a phenolic screw cap having a polyethylene liner. A 20×14 mm. truncated conical flanged polyethylene thimble, Model No. S-2, sold by Mallinckrodt, Inc., Raleigh, N.C., having a wall thickness of about 1 mm., was cut with a razor blade to form a thin horizontal slit approximately 10 mm. long just below the flange 9 and a short angled cut also about 10 mm. long to from a short flap whose sides normally remain flush with the sidewall of the thimble to keep the opening normally closed.

As many possible embodiments may be made of this invention without departing from the scope thereof, it is to be understood that all matter set forth above or shown in the drawings is to be interpreted in an illustrative and not in a limiting sense.

I claim:

1. A container for the transport and storage of metallic memory comprising a bottle having a neck which terminates in a rim, a truncated conical thimble disposed within said neck, said thimble having a flange adapted to rest on said rim, at least one opening having closure means, said opening formed in the upper side wall of said thimble adapted to allow a one way entry into the thimble of a small amount of expanding mercury which is retained in the thimble and separated from the rest of the mercury in the bottle, and a closure member adapted to engage the outer surface of said neck and the upper surface of said flange thereby sealing said bottle and said thimble against the loss of any mercury contained therein.

2. The container of claim 1 in which the closure member is threaded and engages threads formed on outer surface of said neck.

3. The container of claim 1 in which the thimble is made of plastic.

4. The container of claim 1 in which the opening formed in the upper sidewall of the thimble is closed by a substantially horizontal flap whose sides are normally flush with said sidewall to close the opening.

5. The container of claim 1 in which the opening formed in the upper sidewall of the thimble is formed by a pair of intersecting slits between 10 mm. and 20 mm. long.

* * * * *

UNITED STATES PATENT AND TRADEMARK OFFICE

CERTIFICATE OF CORRECTION

PATENT NO. : 4,416,382

DATED : November 22, 1983

INVENTOR(S) : James B. Lawrence et al.

It is certified that error appears in the above-identified patent and that said Letters Patent is hereby corrected as shown below:

Column 3, line 6, claim 1, "memory" should read -- mercury --.

Signed and Sealed this

*Thirty-first* Day of *January 1984*

[SEAL]

*Attest:*

GERALD J. MOSSINGHOFF

*Attesting Officer*

*Commissioner of Patents and Trademarks*